United States Patent [19]

Pillhoefer

[11] Patent Number: 4,878,952

[45] Date of Patent: Nov. 7, 1989

[54] PROCESS FOR HEAT TREATING CAST NICKEL ALLOYS

[75] Inventor: Horst Pillhoefer, Karlsfeld, Fed. Rep. of Germany

[73] Assignee: MTU Motoren-und Turbinen-Union Muenchen GmbH, Munich, Fed. Rep. of Germany

[21] Appl. No.: 243,424

[22] Filed: Sep. 12, 1988

[30] Foreign Application Priority Data

Sep. 19, 1987 [DE] Fed. Rep. of Germany ..... 3731598

[51] Int. Cl.[4] ..... C22F 1/10

[52] U.S. Cl. ..... 148/1; 148/131; 148/162; 148/410

[58] Field of Search ..... 148/1, 4, 13, 131, 162, 148/410

[56] References Cited

U.S. PATENT DOCUMENTS 3,753,790 8/1973 Walker et al. ..... 148/162

FOREIGN PATENT DOCUMENTS 3415282 12/1984 Fed. Rep. of Germany .

*Primary Examiner*—R. Dean

*Attorney, Agent, or Firm*—W. G. Fasse; D. H. Kane, Jr.

[57] ABSTRACT

Cast structural components of nickel alloys are heat treated by heating to a temperature above the incipient melting temperature of the carbidic $\gamma/\gamma'$ eutectic phase, whereby homogenizing and complete solution annealing of the material structure is acheived. Thereafter, the resultant fusion pores are closed at low temperature.

2 Claims, 2 Drawing Sheets

PROCESS FOR HEAT TREATING CAST NICKEL ALLOYS

FIELD OF THE INVENTION

This invention relates to a process for the heat treatment of cast nickel alloy structural components.

DESCRIPTION OF THE PRIOR ART

In the manufacture of cast nickel alloy components by the socalled investment casting process resulting in high quality castings, conflicting requirements arise regarding the castability of the alloy and regarding the properties of the alloy.

To make sure that the mold shell of the often geometrically intricate components is completely wetted by the melt, the melt must be prevented from solidifying too rapidly during the pouring operation, i.e., the melt must cool slowly when in the molten condition. This slow solidification results in excessive separation or dendritic segregation of elements e.g. Al, Ti, Nb, and phase constituents e.g. $\gamma'$ phase, carbidic eutectic, and generally low-melting phases in the alloy. Dendritic non-equidistribution of this type considerably degrades the properties of the cast structural component, especially the creep and stressto-rupture strength of the material. A uniform microstructure, especially a uniform, preferably high content of hardening $\gamma'$ phase in defined particle form, would benefit the material properties. In the investment casting technique this uniform microstructure can be achieved only by a maximally rapid solidification, whereby the risk of misruns, or rather melt flow flaws, and a high percentage of castings with an undesirable porosity cannot be avoided.

Priority normally goes to a high castability of the melt material, and a subsequent heat treatment is then applied to improve the material properties.

U.S. Pat. No. 3,753,790 discloses such a subsequent heat treatment process for superalloys, wherein the treatment temperature is incrementally increased to a point below the incipient melting temperature, so that segregated low-melting phases are homogenized. This technique has the disadvantage that the incipient melting temperature cannot exactly be indicated due to segregation-related scatter. As a result, the holding temperature may be set too far below the incipient melting temperature, whereby a complete solution annealing and homogenization of the $\gamma'$ phase is prevented, or else the initial melting temperature is exceeded, or the holding temperature may exceed the incipient melting temperature whereby an unfavorable fusion porosity of the cast product ensues.

German Patent Publication (DE-OS) 3,415,282 discloses a heat treatment procedure for monocrystalline bodies heated to a point just above the incipient melting temperature to reduce fusion-induced porosities especially those caused by prior heat treatments. This procedure, however, applies to monocrystalline bodies exclusively, since these exhibit a small eutetic and a small low-melting phase and are very homogenous in their solidification. This procedure, therefore, is not suitable for conventional, polycrystalline castings.

OBJECTS OF THE INVENTION

In view of the foregoing it is the aim of the invention to achieve the following objects singly or in combination:

to provide a heat treatment procedure for polycrystalline materials which permits a complete and compensating solution annealing of the $\gamma'$ precipitation hardening phase, while eliminating all fusion porosities; and to provide such a heat treatment especially for cast nickel alloys.

SUMMARY OF THE INVENTION

According to the invention cast structural components of nickel alloy are heat treated as follows:

(a) heating the structural component to a temperature $T_1$ ranging between 0° C. to 10° C. above the incipient melting temperature $T_m$ $\gamma/\gamma'$ of the carbidic $\gamma/\gamma'$ eutectic phase, (b) maintaining this temperature $T_1$ for a length of time sufficient to completely bring into solution and homogenize the partially casting-induced nonuniform $\gamma'$ precipitation phase, (c) cooling to a temperature $T_2$ below $T_m$ $\gamma/\gamma'$ but above the solution temperature T of the $\gamma'$ precipitation hardening phase, (d) maintaining this temperature $T_2$ under hydrostatic pressure between 900 to 2000 bars until the fusion porosity is eliminated, and (e) cooling at a rate required for producing the desired $\gamma'$ precipitation particle phase.

The process of the present invention provides the following special advantages.

Since the heat treatment temperature is raised above the incipient melting temperature $T_m$, complete solution of the $\gamma'$ phase is achieved, especially also in the segregated area or zone. Further, a uniform or equidistribution of the segregated elements, especially of the $\gamma'$ forming elements Al, Ti, and thus of the $\gamma/\gamma'$ phase itself is possible.. A casting process-related oversize fraction of carbidic $\gamma/\gamma'$ eutetics is brought into solution and homogenized by the present process. In this manner, additional $\gamma'$ forming elements in the matrix are brought into solution and can be used for $\gamma'$ precipitation hardening.

At this temperature $T_1$, incipient melting will occur in the carbidic $\gamma/\gamma'$ eutectic phase in small areas. These small, isolated incipient melting areas may lead to porosity, so-called fusion porosity, of an approximate maximum volume proportion of 0.5%. To eliminate this moderate fusion porosity, the first heat treatment is followed by at least one second holding time under hydrostatic pressure (HIP - hot isostatic pressure), at a temperature below $T_m$ $\gamma/\gamma'$, but above $T_{\gamma' solvus}$. During this second holding time the material is hot isostatic recompacted at HIP conditions commonly used on nickel-base superalloys, i.e. at pressures within the range of 900 to 2000 bar, to eliminate the moderate fusion porosity in accordance with the process of the present invention.

Directly upon completion of this second holding time the material is cooled at a sufficiently high rate to produce the desired precipitation particle hardening of the $\gamma'$ phase. This rate preferably runs in the $>6°$ C./min. range.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Described below is a typical heat treatment in accordance with the present invention of a component made of a nickel-base alloy of the following composition in which the properties are given in mass percent.

| | | | |
|---|---|---|---|
| Carbon (C) | 0.15 to 0.20, | Silicon (Si) | 0 to 0.2, |
| Manganese (Mn) | 0 to 0.2, | Sulfur (S) | 0 to 0.015, |
| Aluminum (Al) | 5.0 to 6.0, | Silver (Ag) | 0 to 0.0005, |
| Bismuth (Bi) | 0 to 0.00003, | Boron (B) | 0.010 to 0.020, |
| Cobalt (Co) | 13.0 to 17.0, | Chromium (Cr) | 8.0 to 11.0, |
| Copper (Cu) | 0 to 0.2, | Iron (Fe) | 0 to 1.0, |
| Lead (Pb) | 0 to 0.0005, | Selenium (Se) | 0 to 0.0003, |
| Molybdenum (Mo) | 2.0 to 4.0, | Titanium (Ti) | 4.5 to 5.0, |
| Vanadium (V) | 0.7 to 1.2, | Zirconium (Zr) | 0.03 to 0.09, |
| Nickel (Ni) | remainder, | Tin (Sn) | 0 to 0.0025, |
| Tellurium (Te) | 0.0001, | Thallium (Tl) | 0 to 0.0005. |

This material is known under its designation IN 100. The component treated in this manner was then component tested against a conventionally treated IN 100 component, as will be explained below with reference to FIGS. 2 and 3.

EXAMPLE:

A production cast IN 100 component was first incrementally or continuously heated to a temperature running between 1231° C. and 1245° C. at a well controlled heat-up rate of approximately 10° C. per minute, whereby a thermal overshoot upon reaching the specified temperature was avoided.

Figure 1:
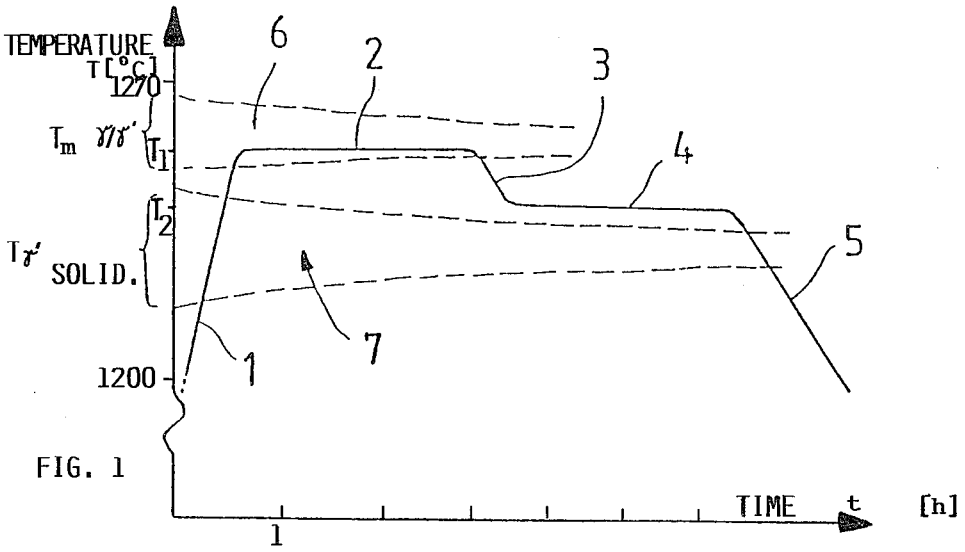
FIG. 1 illustrates schematically the temperature as a function of time of the heat treatment process of the present invention.

FIG. 1 schematically illustrates the temperature-time profile of the heat treatment process according to the invention, wherein for the incipient melting temperature $T_m$ $\gamma/\gamma'$ and for the solution temperature $T_{\gamma'/solvus}$ ranges are plotted on the ordinate, since due to casting process-related dendritic segregations and the normal scatter in the alloy composition, an accurate numerical value cannot generally be indicated. On the graph, region 1 shows the heating-up process. The component was held at the heated-up temperature $T_1$ for the duration of one to two hours, as is shown by region 2. Due to the temperature $T_1$, the $\gamma'$ precipitation phase is brought into solution and the material is homogenized. In the process also the $\gamma/\gamma'$ eutectic areas partially go into solution. This homogenization of the material causes the relatively wide $T_m$ $\gamma/\gamma'$ and the $T_{\gamma'solvus}$ temperature ranges to narrow and finally come within the band widths given by the scatter in alloy composition, as is indicated by reference numerals 6 and 7. A temporary disadvantage here encountered is that due to the abrupt change in material density, incipient melting will cause pores during cooling.

Thereafter, incremental or continuous cooling, as shown in region 3, to a temperature between 1210° C. and 1220° C. is applied. Concurrently, a hot isostatic compacting pressure of 1000 bars is applied. At this temperature the component was held for a duration of at least one hour, but preferably of several hours, as shown in region 4.

In the foregoing treatment the fusion pores that had formed in the material were caused to fill again. Thereafter, the sample was cooled at a rate of at least 6° C. per minute down to 1000° C., as shown in region 5, followed by conventional cooling to room temperature.

A number of components treated in this manner were subjected to component testing under a tensile load of 170 MPa at 950° C. For comparative purposes, a number of identically shaped production cast IN 100 components were hot isostatic pressed applying 1000 bar at 1220° C. for a duration of 4 hours, and then tested under the same conditions. Evaluated per logarithmic normal distribution with a number of samples $n>10$ were the mean time to fracture (=50% failure probability) and the $-2\ \sigma$ value (=2.3% failure probability). This gave the following durations to fracture:

| Components | Mean Duration to Fracture | $-2\ \sigma$ value |
|---|---|---|
| treated in accordance with the invention | 275 h | 230 h |
| comparative components | 175 h | 95 h |

Figure 2:
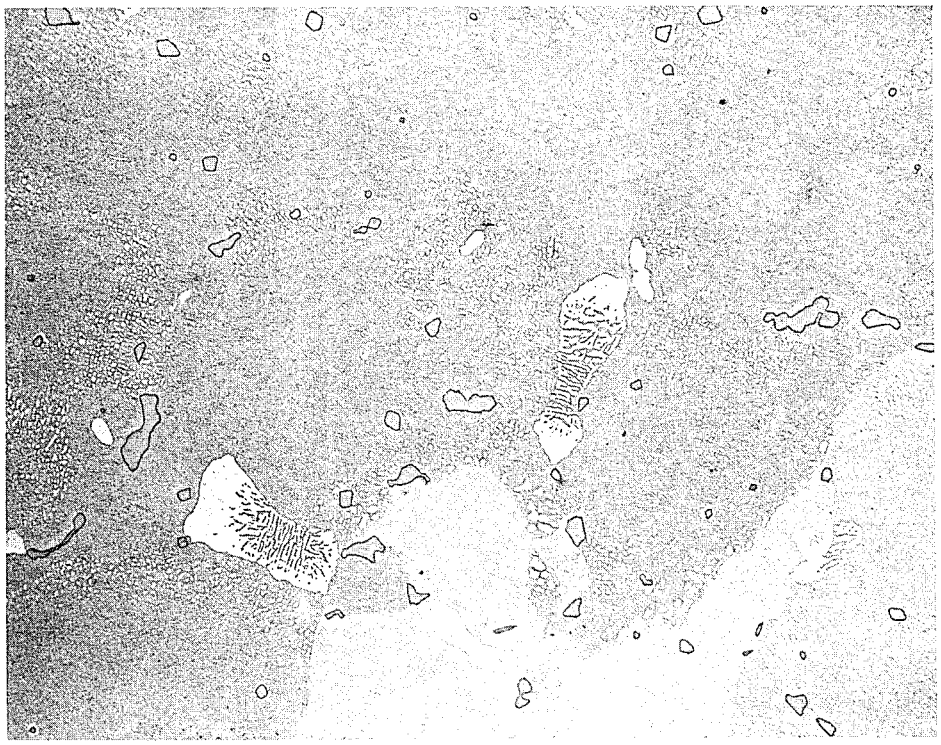
FIG. 2 shows a metallographic section at a 500× magnification of an IN 100 sample prior to the present treatment.

FIG. 2 shows a ground and polished metallographic microsection at 500× magnification of an IN 100 component that was solution annealed at a temperature of 1220° C. for 30 minutes. The plurality of large dendritic non-equidistributions are clearly apparent.

Figure 3:
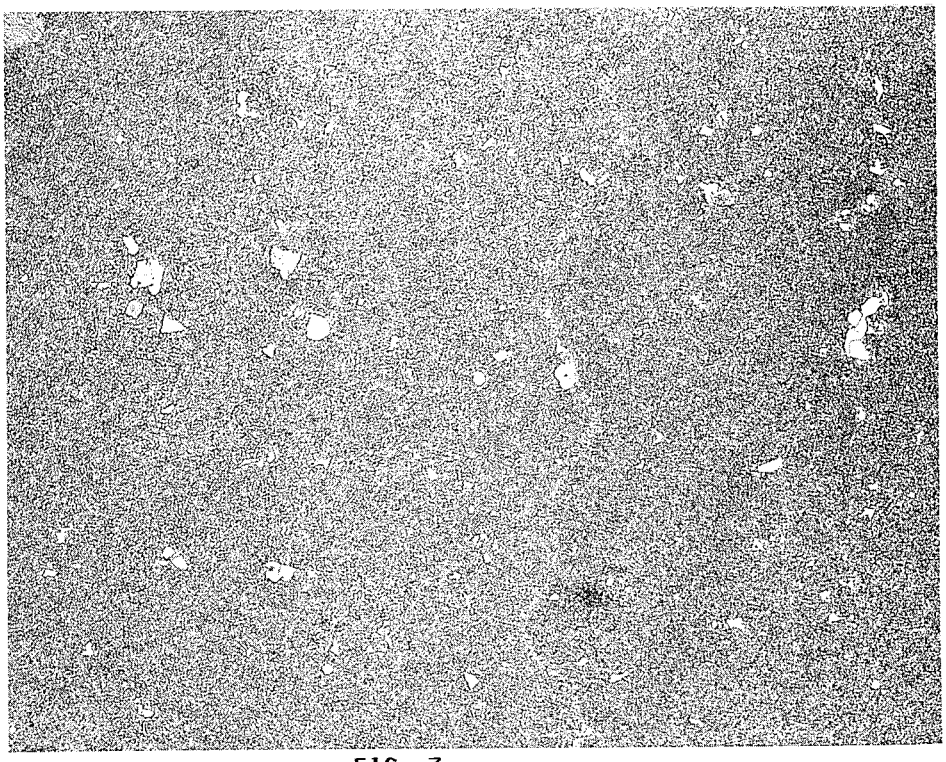
FIG. 3 shows a metallographic section of the same sample at 200× magnification after the present heat treatment.

FIG. 3 shows a ground and polished metallographic microsection at 200× magnification of an IN 100 component subjected to the heat treatment applied in accordance with the present invention. Unlike in FIG. 2, no dendritic non-equidistributions are seen. Instead, a homogeneous structure with finely distributed $\gamma'$ forming elements are apparent. Part of the $\gamma/\gamma'$ eutectics—recognizable as the white areas—has also gone into solution. Importantly, the microstructure is now free of fusion pores.

Figure 4:
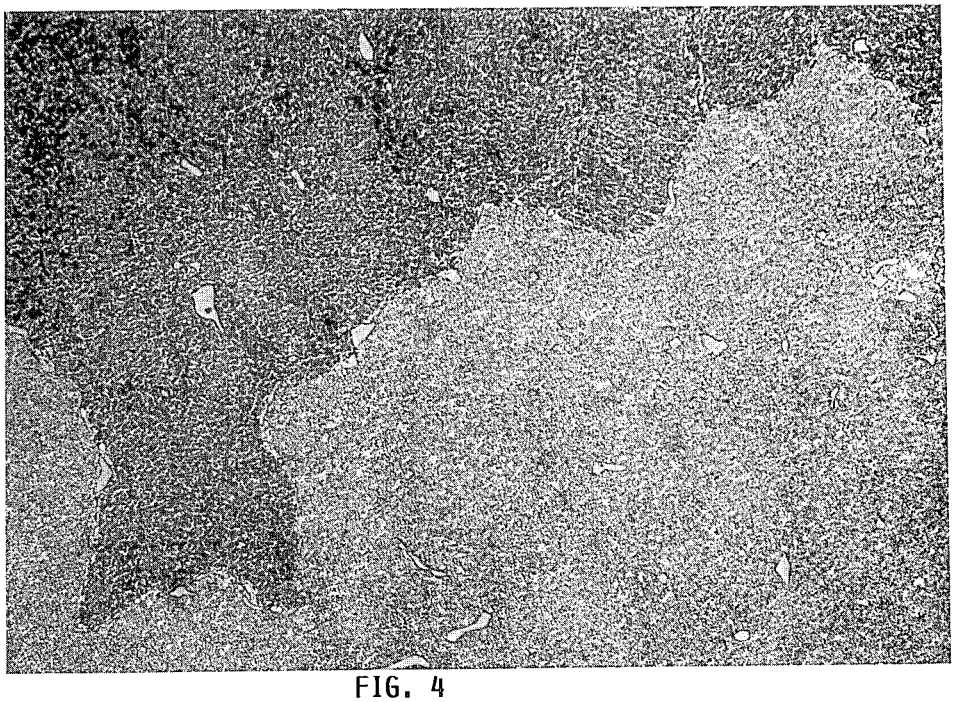
FIG. 4 is a section as in FIG. 3, but at a 500× magnification.

FIG. 4 shows a selective enlargement at 500× magnification of the same microsection as in FIG. 3.

Although the invention has been described with reference to specific example embodiments, it will be appreciated, that it is intended to cover all modifications and equivalents within the scope of the appended claims.

What I claim is:

1. A process for heat treating structural components made of polycrystalline nickel alloys, comprising the following process steps:

(a) heating the structural component to a temperature $T_1$ ranging between 0° C. to 10° C. above the incipient melting temperature $T_m$ $\gamma/\gamma'$ of the carbidic $\gamma/\gamma'$ eutectic phase, (b) maintaining this temperature $T_1$ for a length of time sufficient to completely bring into solution and homogenize the partially casting-inducted non-uniform $\gamma'$ precipitation phase, (c) cooling to a temperature $T_2$ below $T_m$ $\gamma/\gamma'$ but above the solution temperature T of the $\gamma'$ precipitation hardening phase, (d) maintaining this temperature $T_2$ under hydrostatic pressure between 900 to 2000 bars until the fusion porosity is eliminated, and (e) cooling at a rate required for producing the desired $\gamma'$ precipitation particle phase.

2. The method of claim 1, wherein said temperature $T_1$ ranges between 1231° C. to 1245° C. for components having the following composition, in mass percent:

| | | | |
|---|---|---|---|
| Carbon (C) | 0.15%-0.2% | Silicon (Si) | 0-0.2%, |

-continued

| | | | |
|---|---|---|---|
| Manganese (Mn) | 0-0.2%, | Sulfur (S) | 0-0.015%, |
| Aluminum (Al) | 5-6%, | Boron (B) | 0.01-0.02%, |
| Cobalt (Co) | 13-17%, | Chromium (Cr) | 8-11%, |
| Copper (Cu) | 0-0.2%, | Iron (Fe) | 0-1%, |
| Molybdenum (Mo) | 2-4%, | Titanium (Ti) | 4.5-5%, |
| Vanadium (V) | 0.7-1.2%, | Zirconium (Zr) | 0.03-0.09%, |

the remainder being nickel.

* * * * *